US011293613B2

(12) United States Patent
Ueno

(10) Patent No.: US 11,293,613 B2
(45) Date of Patent: Apr. 5, 2022

(54) VEHICLE LUMINAIRE AND VEHICLE LIGHTING TOOL

(71) Applicant: Toshiba Lighting & Technology Corporation, Yokosuka (JP)

(72) Inventor: Misaki Ueno, Ehime-ken (JP)

(73) Assignee: Toshiba Lighting & Technology Corporation, Yokosuka (JP)

( * ) Notice: Subject to any disclaimer, the term of this patent is extended or adjusted under 35 U.S.C. 154(b) by 0 days.

(21) Appl. No.: 17/180,103

(22) Filed: Feb. 19, 2021

(65) Prior Publication Data

US 2021/0317963 A1 Oct. 14, 2021

(30) Foreign Application Priority Data

Apr. 9, 2020 (JP) ..... JP2020-070419

(51) Int. Cl.

| | |
|---|---|
| ***F21S 41/151*** | (2018.01) |
| ***F21S 41/20*** | (2018.01) |
| ***F21S 41/19*** | (2018.01) |
| ***F21S 41/32*** | (2018.01) |
| ***F21S 45/48*** | (2018.01) |
| *F21Y 103/10* | (2016.01) |

(52) U.S. Cl.

CPC ..... *F21S 41/151* (2018.01); *F21S 41/192* (2018.01); *F21S 41/28* (2018.01); *F21S 41/321* (2018.01); *F21S 45/48* (2018.01); *F21Y 2103/10* (2016.08)

(58) Field of Classification Search

CPC ..... F21S 41/151; F21Y 2103/10

See application file for complete search history.

(56) References Cited

U.S. PATENT DOCUMENTS

| | | | | |
|---|---|---|---|---|
| 9,956,902 | B2 | 5/2018 | Fukayama | |
| 2016/0319999 | A1* | 11/2016 | Elzinga | H01L 33/62 |
| 2016/0372515 | A1* | 12/2016 | Miyoshi | H01L 25/0753 |
| 2019/0390830 | A1 | 12/2019 | Hatanaka et al. | |

FOREIGN PATENT DOCUMENTS

| | | | |
|---|---|---|---|
| CN | 203413508 | U | 1/2014 |
| JP | 2011-146483 | A | 7/2011 |
| JP | 2013-137960 | A | 7/2013 |
| JP | 2017-159726 | A | 9/2017 |

* cited by examiner

*Primary Examiner* — Keith G. Delahoussaye
(74) *Attorney, Agent, or Firm* — Banner & Witcoff, Ltd.

(57) ABSTRACT

A vehicle luminaire according to an exemplary embodiment includes: a socket; and a light-emitting module that is provided in on one end side of the socket, and includes only three light-emitting elements. When viewing the vehicle luminaire from a direction along a central axis, light-emitting surfaces of the three light-emitting elements have an approximately rectangular shape or an approximately square shape. At the inside of an approximately rectangular luminous region with the central axis set as the center, the three light-emitting elements are provided in parallel in a row in a direction in which short sides of the luminous region face each other.

14 Claims, 8 Drawing Sheets

(Comparative Art)

VEHICLE LUMINAIRE AND VEHICLE LIGHTING TOOL

CROSS-REFERENCE TO RELATED APPLICATIONS

This application is based upon and claims the benefit of priority from Japanese Patent Application No. 2020-070419, filed on Apr. 9, 2020; the entire contents of which are incorporated herein by reference.

FIELD

Exemplary embodiment described herein relate generally to a vehicle luminaire and a vehicle lighting tool.

BACKGROUND

From the viewpoints of energy saving and a long operation lifespan, a vehicle luminaire equipped with a light-emitting diode are becoming widespread instead of a vehicle luminaire equipped with a filament.

Here, for example, in the case of a vehicle luminaire provided in automobiles, a luminous region that is short in an upper and lower direction and is long in a right and left direction may be required. Accordingly, a technology of arranging a plurality of light-emitting diodes in a row was suggested. However, when simply arranging the plurality of light-emitting diodes in a row, unevenness in luminance occurs in a rectangular luminous region that is long in the right and left direction. When unevenness in luminance occurs, there is a concern that luminous intensity distribution standards determined from the viewpoint of safety may not be satisfied.

Here, it is desired to develop a technology capable of suppressing occurrence of unevenness in luminance in the rectangular luminous region.

DETAILED DESCRIPTION

Figure 1:
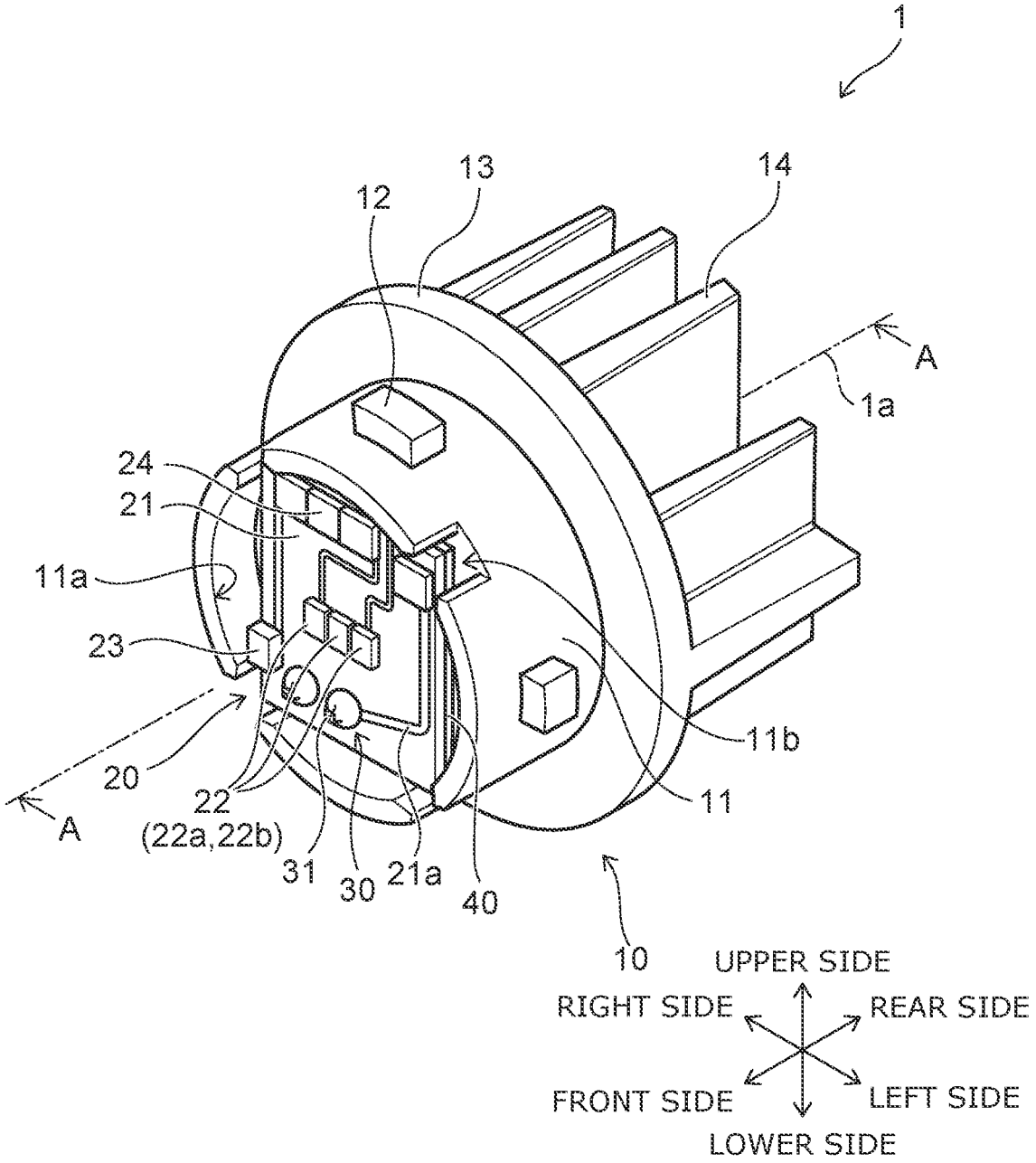
FIG. 1 is a schematic perspective view illustrating a vehicle luminaire according to an exemplary embodiment.

A vehicle luminaire according to an exemplary embodiment includes: a socket; and a light-emitting module that is provided on one end side of the socket and includes only three light-emitting elements. When viewing the vehicle luminaire from a direction along a central axis, light-emitting surfaces of the three light-emitting elements have an approximately rectangular shape or an approximately square shape. At the inside of an approximately rectangular luminous region with the central axis set as the center, the three light-emitting elements are provided in parallel in a row in a direction in which short sides of the luminous region face each other.

Hereinafter, an exemplary embodiment will be described with reference to the accompanying drawings. Note that, in the drawings, the same reference numeral will be given to the same constituent element, and detailed description thereof will be appropriately omitted.

A vehicle luminaire 1 according to this embodiment can be provided, for example, in an automobile. Examples of the vehicle luminaire 1 include vehicle luminaires which can be used in a front combination light (for example, an appropriate combination of a daytime running lamp (DRL), a position lamp, a turn signal lamp, and the like), a rear combination light (for example, an appropriate combination of a stop lamp, a tail lamp, a turn signal lamp, a back lamp, a fog lamp, and the like), and the like. However, the use of the vehicle luminaire 1 is not limited to the examples.

(Vehicle Luminaire)

FIG. 1 is a schematic perspective view illustrating the vehicle luminaire 1 according to this embodiment.

Figure 9:
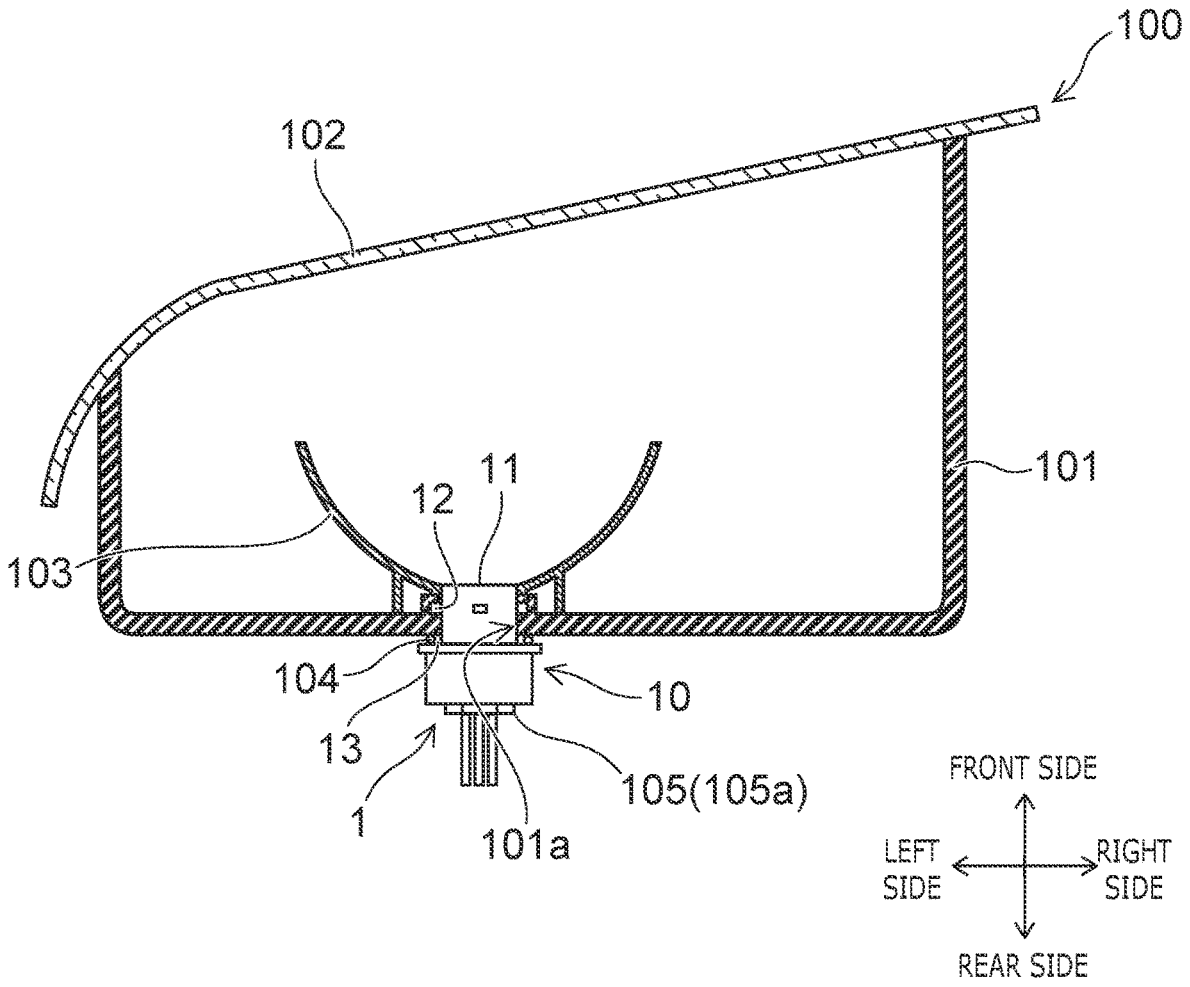
FIG. 9 is a schematic partial cross-sectional view illustrating a vehicle lighting tool.

Note that, in FIG. 9, when mounting the vehicle luminaire 1 to a housing 101 of a vehicle lighting tool 100, a direction that is a forward side of the vehicle lighting tool 100 is set as a front side, a direction that is a rearward side is set as a rear side, a direction that is an upward side is set as an upper side, a direction that is a downward side is set as a lower side, a direction that is a rightward side is set as a right side, and a direction that is a leftward side is set as a left side. In this case, a right and left direction can be set as a horizontal direction. An upper and lower direction can be set as an approximately vertical direction.

Figure 2:
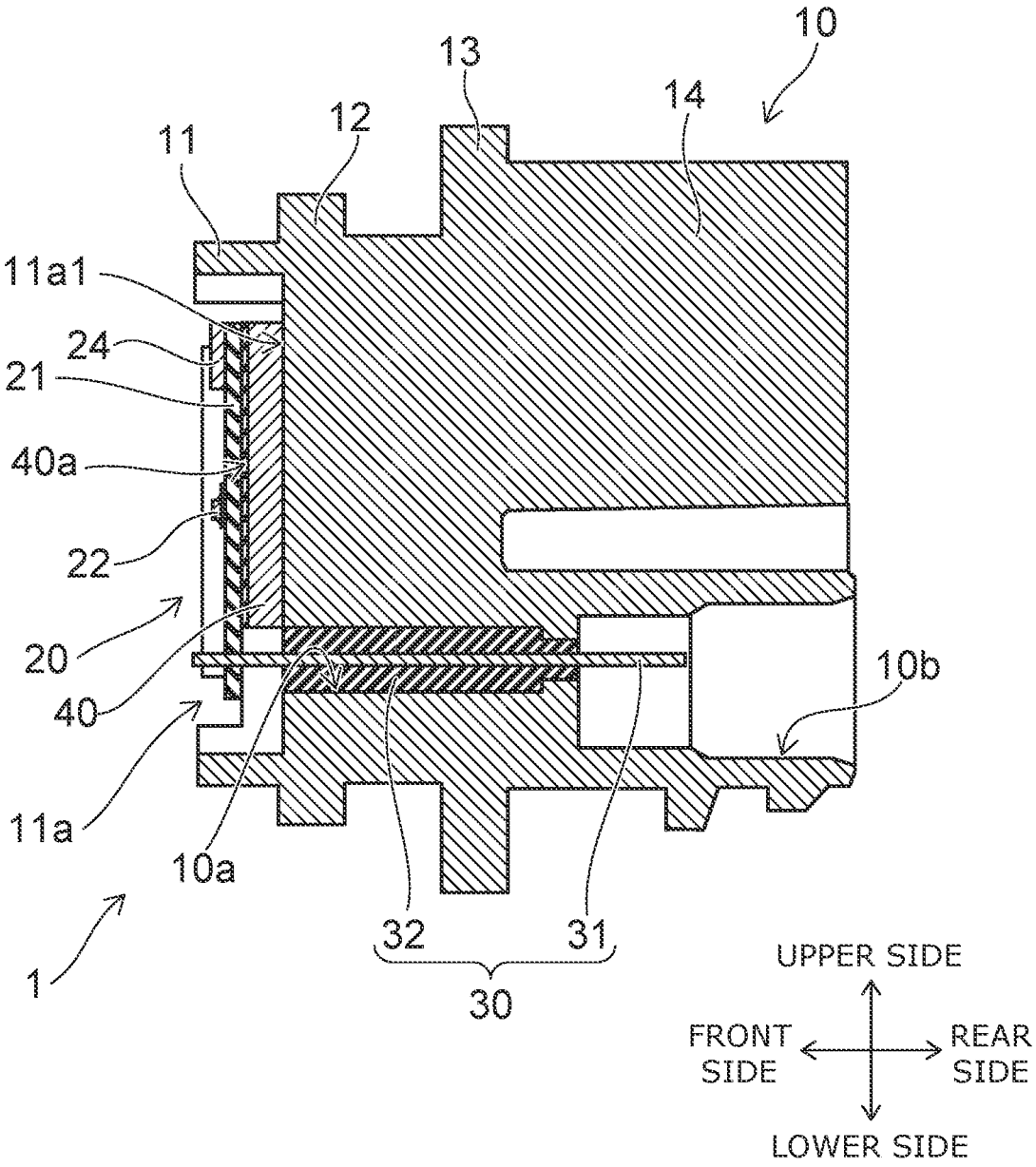
FIG. 2 is a cross-sectional view taken along a direction of line A-A.

FIG. 2 is a cross-sectional view of the vehicle luminaire 1 in FIG. 1 in a direction of line A-A.

As illustrated in FIG. 1 and FIG. 2, a socket 10, a light-emitting module 20, a power-supply part 30, and a heat transfer part 40 can be provided in the vehicle luminaire 1.

The socket 10 can include a mounting part 11, a bayonet 12, a flange 13, and a thermal radiation fin 14.

The mounting part 11 can be provided on a surface of the flange 13 which is opposite to a surface on which the thermal radiation fin 14 is provided. An external shape of the mounting part 11 can be set as a columnar shape. For example, the external shape of the mounting part 11 is a circular column shape. The mounting part 11 can include a concave part 11*a* that is opened to an end on a side opposite to the flange 13 side.

At least one slit 11*b* (shown in FIG. 1) can be provided in the mounting part 11. A corner portion of a board 21 can be provided inside the slit 11*b*. A dimension (width) of the slit 11*b* in a peripheral direction of the mounting part 11 can be set to be slightly larger than a dimension of the corner portion of the board 21. In this case, positioning of the board 21 can be carried out by inserting the corner portion of the board 21 into the slit 11*b*.

In addition, when the slit 11*b* is provided, planar dimensions of the board 21 can be enlarged. According to this, the number of elements mounted on the board 21 can be increased. Alternatively, since the external size of the mounting part 11 can be reduced, a reduction in size of the mounting part 11, and a reduction in size of the vehicle luminaire 1 can be realized.

The bayonet 12 can be provided on an outer surface of the mounting part 11. For example, the bayonet 12 protrudes toward an outer side of the vehicle luminaire 1. The bayonet 12 can be set to face the flange 13. A plurality of the bayonets 12 can be provided. The bayonet 12 can be used when mounting the vehicle luminaire 1 to the housing 101 of the vehicle lighting tool 100. The bayonet 12 can be used for twist lock.

The flange 13 can be set to have a plate shape. For example, the flange 13 can be set to have a disk shape. An outer surface of the flange 13 can be located on an outer side of the vehicle luminaire 1 in comparison to an outer surface of the bayonet 12.

The thermal radiation fin 14 can be provided on a side of the flange 13 which is opposite to the mounting part 11 side. As the thermal radiation fin 14, at least one piece can be provided. For example, a plurality of the thermal radiation fins 14 are provided in the socket 10 illustrated in FIG. 1. The plurality of thermal radiation fins 14 can be provided in parallel in a predetermined direction. The thermal radiation fins 14 can be set to have a plate shape.

As illustrated in FIG. 2, a hole 10*a* and a hole 10*b* that communicates with the hole 10*a* can be provided in the socket 10. A support part 32 can be provided inside the hole 10*a*. Ends of a plurality of power-supply terminals 31 are exposed to the inside of the hole 10*b*. A connector 105 (shown in FIG. 9) including a sealing member 105*a* is inserted into the hole 10*b*, and the connector 105 can be fitted to the ends of the plurality of power-supply terminals 31.

The socket 10 can have a function of holding the light-emitting module 20 and the power-supply part 30, and a function of transferring heat generated in the light-emitting module 20 to the outside. Accordingly, it is preferable that the socket 10 is formed from a material such as a metal having high heat conductivity.

In addition, recently, it is desired for the socket 10 to efficiently thermally radiate heat generated in the light-emitting module 20, and to be light in weight. Accordingly, it is more preferable that the socket 10 is formed from a highly heat conductive resin. For example, the highly heat conductive resin includes a resin and a filler using an inorganic material. For example, the highly heat conductive resin can be set as a material obtained by mixing a filler using carbon or aluminum oxide in a resin such as polyethylene terephthalate (PET) and nylon.

In the case of the socket 10 which contains the highly heat conductive resin, and in which the mounting part 11, the bayonet 12, the flange 13, and the thermal radiation fin 14 are integrally formed, heat generated in the light-emitting module 20 can be efficiently thermally radiated. In addition, the weight of the socket 10 can be reduced. In this case, the mounting part 11, the bayonet 12, the flange 13, and the thermal radiation fin 14 can be integrally formed by using an injection molding method or the like. In addition, the socket 10 and the power-supply part 30 can also be integrally formed by using an insert molding method or the like.

The power-supply part 30 can include a plurality of the power-supply terminals 31 and the support part 32.

The plurality of power-supply terminals 31 can be set as a pin-shaped body. Ends of the plurality of power-supply terminals 31 on the light-emitting module 20 side can be soldered to an output terminal and an input terminal of a wiring pattern 21*a*. Ends of the plurality of power-supply terminals 31 on the thermal radiation fin 14 side can be exposed to the inside of the hole 10*b*. For example, the power-supply terminals 31 can be formed from a metal such as a copper alloy. Note that, the number, the shape, the arrangement, the material, and the like of the power-supply terminals 31 are not limited to the example, and can be appropriately changed.

As described above, it is preferable that socket 10 is formed from a material with high heat conductivity. By the way, the material with high heat conductivity may have electrical conductivity. For example, the highly heat conductive resin or the like which uses a filler containing carbon may have electrical conductivity. According to this, the support part 32 can be provided for insulation between the power-supply terminals 31 and the socket 10 having electrical conductivity. In addition, the support part 32 can also have a function of holding the plurality of power-supply terminals 31. Note that, when the socket 10 is formed from the highly heat conductive resin (for example, a highly heat conductive resin containing a filler using aluminum oxide, or the like) having insulation properties, the support part 32 can be omitted. In this case, the socket 10 can hold the plurality of power-supply terminals 31.

The support part 32 can be formed from a resin having insulation properties. For example, the support part 32 can be pressed into the hole 10*a* provided in the socket 10, or can be bonded to an inner wall of the hole 10*a*.

The heat transfer part 40 can be provided between the socket 10 and the light-emitting module 20. It is preferable that the heat transfer part 40 is formed from a material with high heat conductivity. For example, the heat transfer part 40 can be formed from a metal such as aluminum, an aluminum alloy, copper, and a copper alloy. The heat transfer part 40 can be bonded to a bottom surface 11*a*1 of the concave part 11*a*. In this case, it is preferable to use adhesive with high heat conductivity as adhesive. For example, the adhesive can be set as adhesive in which a filler using an inorganic material is mixed. In addition, the heat transfer part 40 can also be attached to the bottom surface 11*a*1 of the concave part 11*a* through a layer including heat conductive grease (thermal radiation grease). As the heat conductive grease, for example, grease obtained by mixing a filler using an inorganic material in modified silicone can be used. In addition, the heat transfer part 40 can also be inserted into the bottom surface 11*a*1 of the concave part 11*a* by using an insert molding method or the like.

Note that, when heat generated in the light-emitting module 20 is less, the heat transfer part 40 can also be omitted. When the heat transfer part 40 is omitted, for example, the light-emitting module 20 can be bonded to the bottom surface 11*a*1 of the concave part 11*a*.

The light-emitting module 20 can be provided on one end side of the socket 10.

As illustrated in FIG. 1 and FIG. 2, the light-emitting module 20 can include the board 21, a light-emitting element 22, a diode 23, and a resistor 24.

The board 21 has a plate shape. For example, a planar shape of the board 21 can be set as an rectangular shape. For example, the board 21 can be bonded to a surface 40*a* of the heat transfer part 40 on a side opposite to the bottom surface 11*a*1 side of the concave part 11*a*. As adhesive for bonding the board 21 to the heat transfer part 40, the same adhesive for bonding the heat transfer part 40 to the bottom surface 11*a*1 of the concave part 11*a* can be used. For example, the board 21 can be formed from an inorganic material such as ceramics (for example, aluminum oxide, aluminum nitride, and the like), an organic material such as paper phenol and glass epoxy, or the like. In addition, the board 21 may be a member obtained by coating a surface of a metal plate with an insulating material. When the amount of heat generation in the light-emitting element 22 is large, from the viewpoint of thermal radiation, it is preferable that the board 21 is formed by using a material with high heat conductivity. Examples of the material with high heat conductivity include ceramics such as aluminum oxide and aluminum nitride, a highly heat conductive resin, a member obtained by coating a surface of a metal plate with an insulating material, and the like. In addition, the board 21 may have a single-layer structure, or a multi-layer structure.

In addition, the wiring pattern 21*a* can be provided on the surface of the board 21. For example, the wiring pattern 21*a* can be formed from a material containing silver as a main component, a material containing copper as a main component, or the like.

For example, the light-emitting element 22 can be set as a light-emitting diode, an organic light-emitting diode, a laser diode, or the like. For example, the light-emitting element 22 can be set as a surface mounting type light-emitting element. When viewing the vehicle luminaire 1 from a direction along a central axis 1*a*, a planar shape of a light-emitting surface 22*a* (upper surface) of the light-emitting element 22 can be set as an approximately rectangular shape.

As the light-emitting element 22, three pieces can be provided. The three light-emitting elements 22 can be provided on a side of the board 21 which is opposite to the heat transfer part 40 side. The three light-emitting elements 22 can be electrically connected to the wiring pattern 21*a*. The three light-emitting elements 22 can be connected in series.

The three light-emitting elements 22 can be provided in parallel in a row in the right and left direction. In this case, the three light-emitting elements 22 can be aligned in parallel so that long sides of the light-emitting surface 22*a* are adjacent to each other.

When viewing the vehicle luminaire 1 from a direction along the central axis 1*a*, one of the light-emitting elements 22 can be provided at a position that overlaps the central axis 1*a* of the vehicle luminaire 1. In this case, it is preferable that the center of the one light-emitting element 22 overlaps the central axis 1*a* of the vehicle luminaire 1. One of the remaining light-emitting elements 22 can be provided on a left side of the light-emitting element 22 provided at the position that overlaps the central axis 1*a*. The remaining one light-emitting element 22 can be provided on a right side of the light-emitting element 22 provided at the position that overlaps the central axis 1*a*.

Note that, details relating to arrangement of the three light-emitting elements 22 and the like will be described later.

The diode 23 can be provided on a side of the board 21 which is opposite to the heat transfer part 40. The diode 23 can be electrically connected to the wiring pattern 21*a*. The diode 23 can be connected to the three light-emitting elements 22 in series. The diode 23 can be provided so that a reverse voltage is not applied to the light-emitting elements 22, and a pulse noise from the reverse direction is not applied to the light-emitting elements 22. For example, the diode 23 can be set as a surface mounting type diode, a diode including a lead wire, or the like. The diode 23 illustrated in FIG. 1 is the surface mounting type diode.

The resistor 24 can be provided on a side of the board 21 which is opposite to the heat transfer part 40 side. The resistor 24 can be electrically connected to the wiring pattern 21*a*. For example, the resistor 24 can be set as a surface mounting type resistor, a resistor (metal oxide film resistor) including a lead wire, a film-shaped resistor formed by using a screen printing method or the like, or the like. Note that, the resistor 24 illustrated in FIG. 1 is the film-shaped resistor.

For example, a material of the film-shaped resistor can be set as ruthenium oxide ($RuO_2$). For example, the film-shaped resistor can be formed by using a screen printing method and a baking method. When the resistor 24 is the film-shaped resistor, a contact area between the resistor 24 and the board 21 can be enlarged, and thus thermal radiation properties can be improved. In addition, a plurality of the resistors 24 can be formed at a time. Accordingly, productivity can be improved. In addition, a variation in a resistance value in the plurality of resistors 24 can be suppressed.

Here, since a variation exists in forward voltage characteristics of each of the light-emitting elements 22, when an application voltage between an anode terminal and a ground terminal is set to be constant, a variation occurs in the brightness (luminous flux, luminance, luminous intensity, and illuminance) of light emitted from the light-emitting element 22. Accordingly, a value of a current flowing to the light-emitting element 22 is set to be within a predetermined range by the resistor 24 so that the brightness of light emitted from the light-emitting element 22 enters a predetermined range. In this case, the value of the current flowing to the light-emitting element 22 is set to be within the predetermined range by changing a resistance value of the resistor 24.

In a case where the resistor 24 is a film-shaped resistor, when a part of the resistor 24 is removed, the resistance value can be increased. For example, the part of the resistor 24 can be easily removed by irradiating the resistor 24 with laser light. When the resistor 24 is a surface mounting type resistor, a resistor including a lead wire, or the like, the resistor 24 having an appropriate resistance value can be selected in correspondence with the forward voltage characteristics of the light-emitting element 22. The number, size, arrangement, and the like of the resistor 24 are not limited to the exemplary configuration, and can be appropriately changed in correspondence with specifications of the light-emitting element 22, and the like.

A pull-down resistor can also be provided for detection of disconnection, prevention of erroneous lighting, and the like in the light-emitting element 22. In addition, a covering part that covers the wiring pattern 21*a*, the film-shaped resistor, and the like can also be provided. For example, the covering part can contain a glass material.

Next, description will be further given of arrangement of the three light-emitting elements 22, and the like.

In the case of the vehicle luminaire 1 provided in an automobile, in a luminous region 200 that is short in the upper and lower direction (approximately vertical direction), and is long in the right and left direction (approximately horizontal direction), it may be required for luminance to be uniform as can as possible (to suppress occurrence of unevenness in luminance). For example, in the luminous region 200, when unevenness in luminance occurs, there is a concern that luminous intensity distribution standards determined from the viewpoint of safety may not be satisfied.

Figure 4:
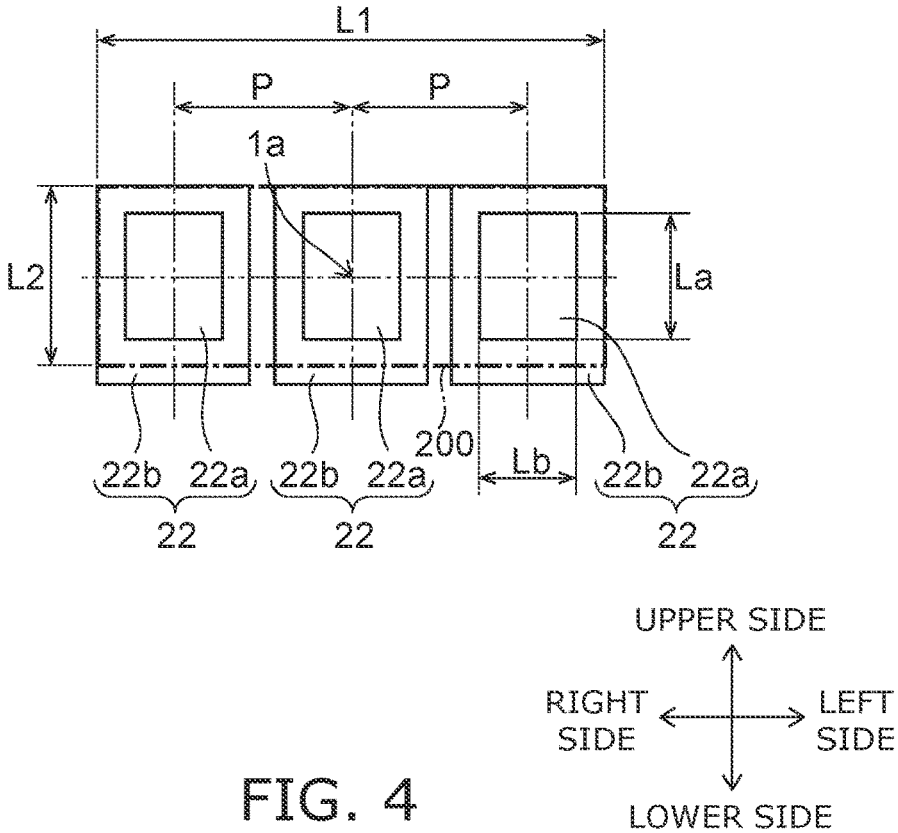
FIG. 4 is a schematic plan view illustrating light-emitting elements and arrangement of the light-emitting elements according to this embodiment.

As illustrated in FIG. 4 to be described later, in the case of the vehicle luminaire 1 provided in an automobile, it is preferable to employ the luminous region 200 having a rectangular shape in which long sides are aligned in the upper and lower direction. For example, when a length of each of the long sides of the rectangular luminous region 200 is set as L1 (mm), a length of each of short sides is set as L2 (mm), L1/L2 can be set to 2.3 to 3.5. For example, the length L1 of the long side of the luminous region 200 can be set to 3.8 to 4.2 (mm), and the length L2 of the short side can be set to 1.2 to 1.6 (mm). Preferably, the length L1 of the long side of the luminous region 200 can be set to 4.0 (mm), and the length L2 of the short side can be set to 1.4 (mm).

In addition, it may be required to enlarge a difference between luminance inside the luminous region 200 and luminance at the periphery of the luminous region 200. For example, when the difference between the luminance inside the luminous region 200 and the luminance at the periphery decreases, luminous intensity distribution determined from the viewpoint of safety may not be satisfied. For example, a maximum value of the peripheral luminance is preferably set to 10% or less of average luminance inside the luminous region 200. In this case, when a light-shielding member is provided on a light emission side of the light-emitting element 22 to shield light at the periphery of the luminous region 200, the difference between luminance inside the luminous region 200 and luminance at the periphery can be enlarged. However, in this case, a part of light emitted from the light-emitting element 22 is absorbed by the light-shielding member, and thus light-emitting efficiency decreases.

Figure 3:
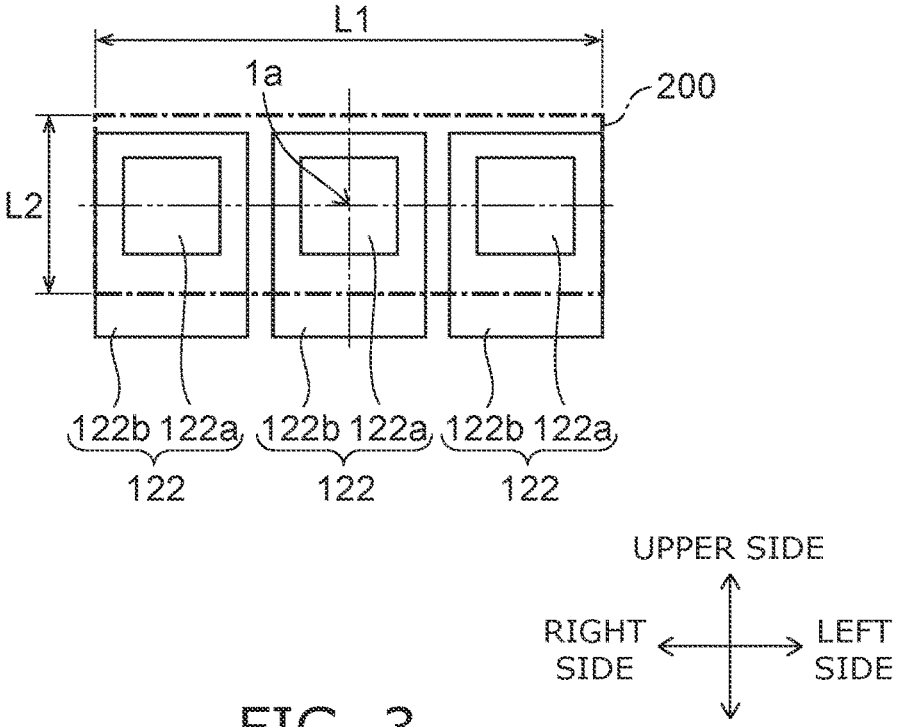
FIG. 3 is a schematic plan view illustrating light-emitting elements and arrangement thereof according to a comparative example.

FIG. 3 is a schematic plan view illustrating a light-emitting element 122 and arrangement thereof according to a comparative example.

The surface mounting type light-emitting element 122 includes a package 122*b*, and a light-emitting surface 122*a* provided in an upper end of the package 122*b*. In addition, when mounting the light-emitting element 122 in the wiring pattern 21*a*, it is necessary to prevent short-circuit with an adjacent light-emitting elements 122 from occurring.

Accordingly, when arranging light-emitting surfaces 122*a* of three pieces of the light-emitting elements 122 inside the luminous region 200, as illustrated in FIG. 3, it is necessary to provide a gap between a plurality of the packages 112*b*. When a gap is provided between the packages 122*b*, in a right and left direction inside the luminous region 200, it is difficult to reduce a dimension between the light-emitting surfaces 122*a*. At the inside of the luminous region 200, when the dimension between the light-emitting surfaces 122*a* is enlarged, luminance between the light-emitting surfaces 122*a* decreases, and unevenness in luminance increases.

In addition, typically, a planar shape of each of the light-emitting surfaces 122*a* of the light-emitting elements 122 is an approximately square shape. As described above, at the inside of the luminous region 200, a length of the light-emitting surface 122*a* in the right and left direction is limited by a dimension between the light-emitting surfaces 122*a*. In addition, when the planar shape of the light-emitting surface 122*a* is the approximately square shape, a length of the light-emitting surface 122*a* in the upper and lower direction becomes the same as the length in the right and left direction. Accordingly, it is difficult to enlarge an area of the light-emitting surface 122*a*, and it is also difficult to suppress unevenness in luminance at the inside of the luminous region 200.

FIG. 4 is a schematic plan view illustrating the light-emitting element 22 and arrangement of the light-emitting element 22 according to this embodiment.

As illustrated in FIG. 4, three pieces of the light-emitting elements 22 can be provided inside the luminous region 200 in parallel in the right and left direction. The surface mounting type light-emitting element 22 includes a package 22*b* and a light-emitting surface 22*a* provided in an upper end of the package 22*b*. For example, the center of the three light-emitting surfaces 22*a* can be provided on a line segment that passes through the central axis 1*a* of the vehicle luminaire 1, and is parallel to the long side of the luminous region 200.

As in the light-emitting element 122, a gap is provided between a plurality of the packages 22*b*. Accordingly, in the right and left direction inside of the luminous region 200, it is difficult to reduce a dimension between a plurality of the light-emitting surfaces 22*a*. At the inside of the luminous region 200, a length of the light-emitting surface 22*a* in the right and left direction is limited by a dimension between the light-emitting surfaces 22*a*, and thus it is difficult to enlarge a length of the light-emitting surface 22*a* in the right and left direction.

Here, in the light-emitting element 22 according to this embodiment, as illustrated in FIG. 4, the planar shape of the light-emitting surface 22*a* is set as an approximately rectangular shape. In this case, the light-emitting element 22 can be provided inside the luminous region 200 so that long sides of the light-emitting surface 22*a* are aligned in parallel in the right and left direction. That is, at the inside of the luminous region 200 having the approximately rectangular shape with the central axis 1*a* set as the center, the three light-emitting elements 22 are provided in parallel in a direction in which long sides of the light-emitting surface 22*a* are aligned in parallel in a direction in which short sides of the luminous region 200 are parallel.

When the planar shape of the light-emitting surface 22*a* is the approximately rectangular shape, the length of the light-emitting surface 22*a* in the upper and lower direction can be enlarged in comparison to the length of the light-emitting surface 22*a* in the right and left direction. Accordingly, even when the length of the light-emitting surface 22*a* in the right and left direction cannot be enlarged, an area of the light-emitting surface 22*a* can be enlarged. When the area of the light-emitting surface 22*a* can be enlarged, it is easy to suppress unevenness in luminance inside the luminous region 200. For example, in the right and left direction inside the luminous region 200, an inter-center distance (pitch dimension) P (mm) of the light-emitting surfaces 22*a* can be set to, for example, 1.2 to 1.6 (mm).

In this case, when the length of the light-emitting surface 22*a* in the upper and lower direction is excessively enlarged, there is a concern that a difference between luminance inside the luminous region 200 and luminance at the periphery becomes excessively small. Accordingly, it is preferable that the length La (mm) of the light-emitting surface 22*a* in the upper and lower direction is set to, for example, 0.8 to 1.4 (mm). In this case, the length Lb (mm) of the light-emitting surface 22*a* in the right and left direction can be set to, for example, 0.7 to 1.0 (mm).

Figure 5:
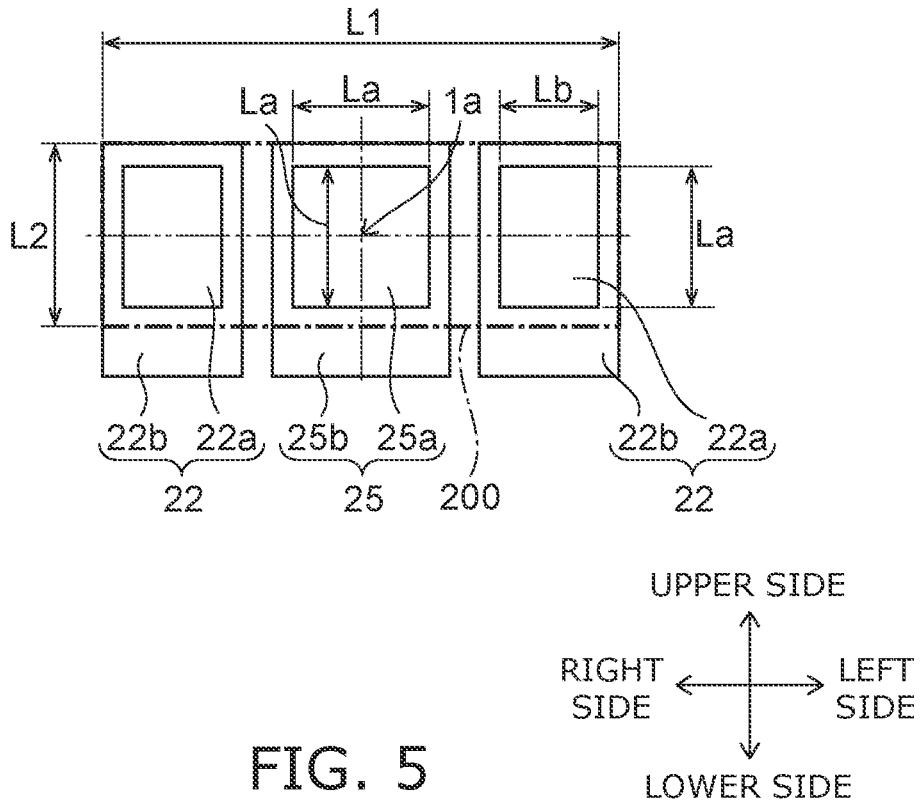
FIG. 5 is a schematic plan view illustrating light-emitting elements and arrangement of the light-emitting element according to another embodiment.

FIG. 5 is a schematic plan view illustrating a light-emitting element and arrangement of the light-emitting element according to another embodiment.

As illustrated in FIG. 5, two light-emitting elements 22 and one light-emitting element 25 can be provided inside the luminous region 200 in parallel in the right and left direction. The light-emitting element 25 can be set as a surface mounting type light-emitting element. Accordingly, the light-emitting element 25 includes a package 25*b* and a light-emitting surface 25*a* that is provided in an upper end of the package 25*b*. The center between two light-emitting surfaces 22*a* and the center of one light-emitting surface 25*a* can be provided, for example, on a line segment that passes through the central axis la of the vehicle luminaire 1, and is parallel to the long sides of the luminous region 200.

That is, when viewing the vehicle luminaire 1 from a direction along the central axis 1*a*, the light-emitting surface 25*a* of the light-emitting element 25 has an approximately square shape, and the light-emitting surfaces 22*a* of the two light-emitting elements 22 have an approximately rectangular shape.

At the inside of the luminous region 200 having an approximately rectangular shape with the central axis 1*a* set as the center, the light-emitting element 25 is provided in parallel between the light-emitting elements 22.

The two light-emitting elements 22 are provided so that long sides of the light-emitting surfaces 22*a* are aligned in parallel in a direction in which the short sides of the luminous region 200 are parallel.

For example, a length of a side of the light-emitting surface 25*a* of which a planar shape is an approximately square shape can be set to be approximately the same as the length La (mm) of the light-emitting surface 22*a* in the upper and lower direction. That is, the length of the side of the light-emitting surface 25*a* can be set to be approximately the same as the length La (mm) of the long side of the light-emitting surface 22*a*.

As described above, in the luminous region 200, the length L1 (mm) of the long side and the length L2 (mm) of the short side are within a predetermined range. Accordingly, when the number of the light-emitting elements is set to 3, at the inside of the luminous region 200, unevenness in luminance may be likely to occur. For example, when the length L1 (mm) of the long side of the luminous region 200 is long, a distance between the light-emitting surface 22*a* and the light-emitting surface 25*a* is enlarged, and thus at the inside of the luminous region 200, luminance between the light-emitting surface 22*a* and the light-emitting surface 25*a* may decrease. In this case, it is preferable that the length of the light-emitting surface 25*a* in the right and left direction is set to be longer than the length of the light-emitting surface 22*a* in the right and left direction. In this configuration, it is possible to suppress luminance between the light-emitting surface 22*a* and the light-emitting surface 25*a* from being decreased at the inside of the luminous region 200.

In this case, it is preferable that (Lb+La+Lb)/L1 becomes 0.6 or greater. According to this, since sufficient luminance can be obtained at the inside of the luminous region 200, a region with low luminance is suppressed from occurring at the inside of the luminous region 200. That is, in the luminous region 200, occurrence of unevenness in luminance can be suppressed.

Figure 6A:
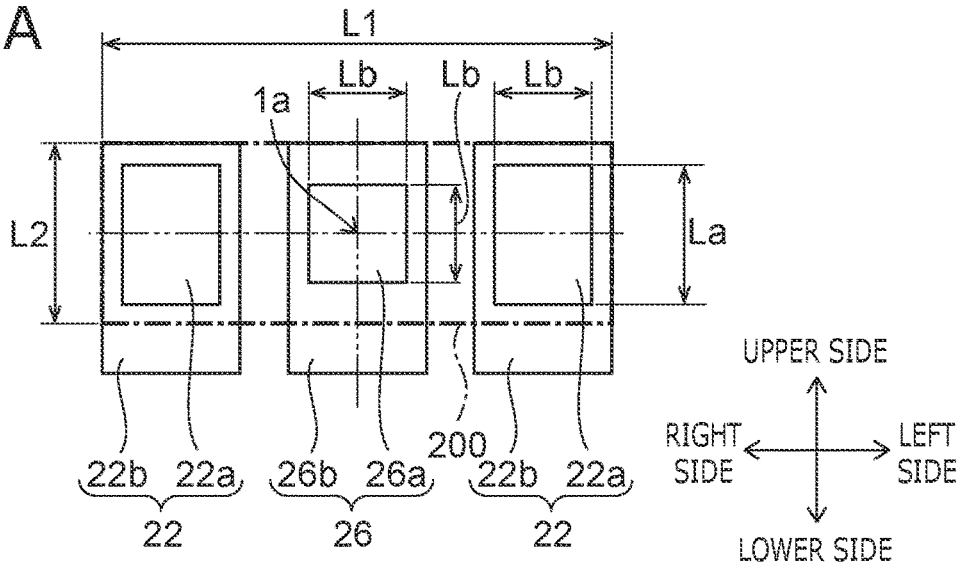
FIGS. 6A to 6C are schematic plan views illustrating light-emitting elements and arrangement of the light-emitting elements according to still another embodiment.
Figure 6B:
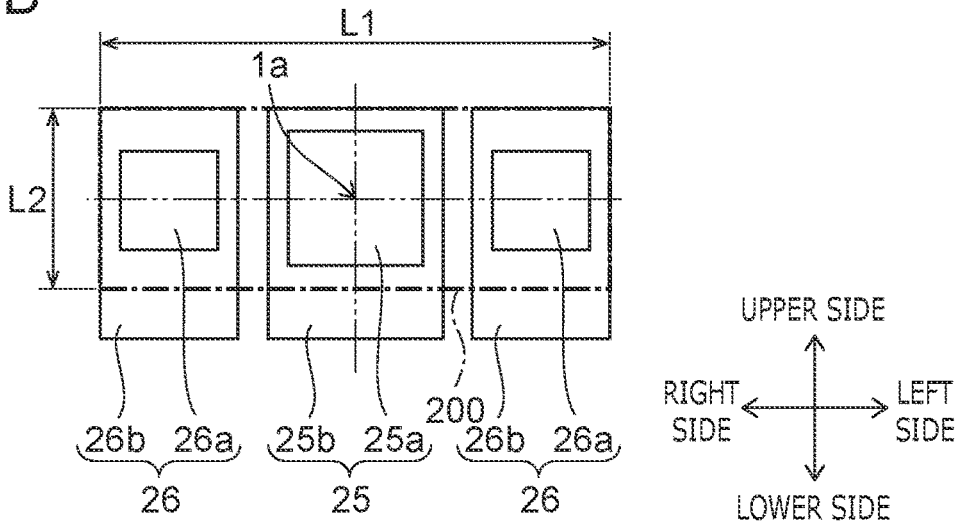
Figure 6C:
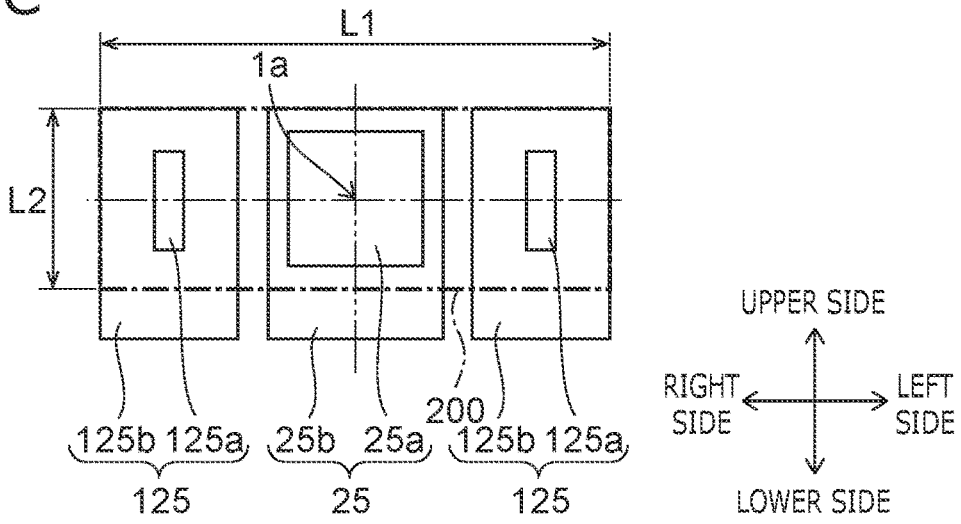

FIGS. 6A to 6C are schematic plan views illustrating a light-emitting element and arrangement of the light-emitting element according to still another embodiment.

As illustrated in FIG. 6A, at the inside of the luminous region 200, two light-emitting elements 22 (corresponding to an example of the third light-emitting elements) and one light-emitting element 26 (corresponding to an example of the second light-emitting element) can be provided in parallel in the right and left direction. The light-emitting element 26 can be set as the surface mounting type light-emitting element. Accordingly, the light-emitting element 26 includes a package 26*b* and a light-emitting surface 26*a* provided in an upper end of the package 26*b*. The center of two light-emitting surfaces 22*a* and the center of the one light-emitting surface 26*a* can be provided, for example, on a line segment that passes through the central axis 1*a* of the vehicle luminaire 1 and is parallel to the long side of the luminous region 200.

That is, when viewing the vehicle luminaire 1 from a direction along the central axis 1*a*, the light-emitting surface 26*a* of the light-emitting element 26 has an approximately square shape, and the light-emitting surfaces 22*a* of the two light-emitting elements 22 have an approximately rectangular shape.

At the inside of the luminous region 200 having an approximately rectangular shape with the central axis 1*a* set as the center, the light-emitting element 26 is provided in parallel between the light-emitting elements 22.

The two light-emitting elements 22 are provided so that long sides of the light-emitting surface 22*a* are aligned in parallel in a direction in which the short sides of the luminous region 200 face each other.

For example, a length of a side of the light-emitting surface 26*a* of which a planar shape is an approximately square shape can be set to be approximately the same as a length Lb (mm) of the light-emitting surface 22*a* in the right and left direction. That is, the length of the side of the light-emitting surface 26*a* can be set to be approximately the same as the length Lb (mm) of a short side of the light-emitting surface 22*a*.

As described above, in the luminous region 200, the length L1 (mm) of the long side and the length L2 (mm) of the short side are within a predetermined range. Accordingly, when the length L1 (mm) of the long side of the luminous region 200 is short, luminance near the center of the luminous region 200 may be excessively high. In this case, an area of the light-emitting surface 26*a* of the light-emitting element 26 provided near the center of the luminous region 200 can be reduced. In this configuration, in the luminous region 200, occurrence of unevenness in luminance can be suppressed.

As illustrated in FIG. 6B, at the inside of the luminous region 200, two light-emitting elements 26 (corresponding to an example of second light-emitting elements), and one light-emitting element 25 (corresponding to an example of a first light-emitting element) can be provided in parallel in the right and left direction. The center of two light-emitting surfaces 26*a* and the center of one light-emitting surface 25*a* can be provided, for example, on a line segment that passes through the central axis 1*a* of the vehicle luminaire 1, and is parallel to the long side of the luminous region 200.

That is, when viewing the vehicle luminaire 1 from a direction along the central axis 1*a*, the light-emitting surface 25*a* of the light-emitting element 25 has an approximately square shape, and the light-emitting surfaces 26*a* of the two light-emitting elements 26 have an approximately square shape.

At the inside of the luminous region 200 having an approximately rectangular shape with the central axis 1*a* set as the center, the light-emitting element 25 is provided in parallel between the light-emitting elements 26.

The light-emitting surface 25*a* of the light-emitting element 25 is larger than each of the light-emitting surfaces 26*a* of the light-emitting elements 26.

As described above, in the luminous region 200, the length L1 (mm) of the long side and the length L2 (mm) of the short side are within a predetermined range. Accordingly, a difference between luminance inside the luminous region 200 and luminance of the periphery of the luminous region 200 may be excessively small depending on the lengths. For example, in the right and left direction, luminance of the periphery of ends of the luminous region 200 may be excessively high. In this case, in the right and left direction, an area of the light-emitting surfaces 26*a* of the light-emitting elements 26 provided near the ends of the luminous region 200 can be reduced. Note that, as illustrated in FIG. 6B, the light-emitting surfaces 26*a* can be set to have an approximately square shape. In this configuration, a difference between luminance inside the luminous region 200 and luminance of the periphery of the luminous region 200 can be enlarged.

As illustrated in FIG. 6C, at the inside of the luminous region 200, two light-emitting elements 125 (corresponding to an example of the third light-emitting elements) and one light-emitting element 25 (corresponding to an example of the second light-emitting element) can be provided in parallel in the right and left direction. The center of two light-emitting surfaces 125*a* and the center of one light-emitting surface 25*a* can be provided on a line segment that passes through the central axis 1*a* of the vehicle luminaire 1 and is parallel to the long side of the luminous region 200.

That is, when viewing the vehicle luminaire 1 from a direction along the central axis 1*a*, the light-emitting surface 25*a* of the light-emitting element 25 has an approximately square shape, and the light-emitting surfaces 125*a* of the two light-emitting elements 125 have an approximately rectangular shape.

At the inside of the luminous region 200 having an approximately rectangular shape with the central axis 1*a* set as the center, the light-emitting element 25 is provided in parallel between the light-emitting elements 125.

The two light-emitting elements 125 are provided so that long sides of the light-emitting surfaces 125*a* are aligned in parallel in a direction in which the short sides of the luminous region 200 are parallel.

As described above, in the luminous region 200, the length L1 (mm) of the long side and the length L2 (mm) of the short side are within a predetermined range. Accordingly, a difference between luminance inside the luminous region 200 and luminance of the periphery of the luminous region 200 may be excessively small depending on the lengths. For example, in the right and left direction, luminance of the periphery of ends of the luminous region 200 may be excessively high. In this case, in the right and left direction, an area of the light-emitting surfaces 125*a* of the light-emitting elements 125 provided near the ends of the luminous region 200 can be reduced. Note that, as illustrated in FIG. 6C, the light-emitting surfaces 125*a* can be set to have an approximately rectangular shape. Long sides of the light-emitting surfaces 125*a* can be aligned in parallel in a direction in which the short sides of the luminous region 200 face each other. In this configuration, a difference between luminance inside the luminous region 200 and luminance of the periphery of the luminous region 200 can be enlarged.

The above-described light-emitting elements 22, 25, 26, and 125 are the surface mounting type light-emitting elements, but may be chip-shaped light-emitting elements.

Figure 7A:
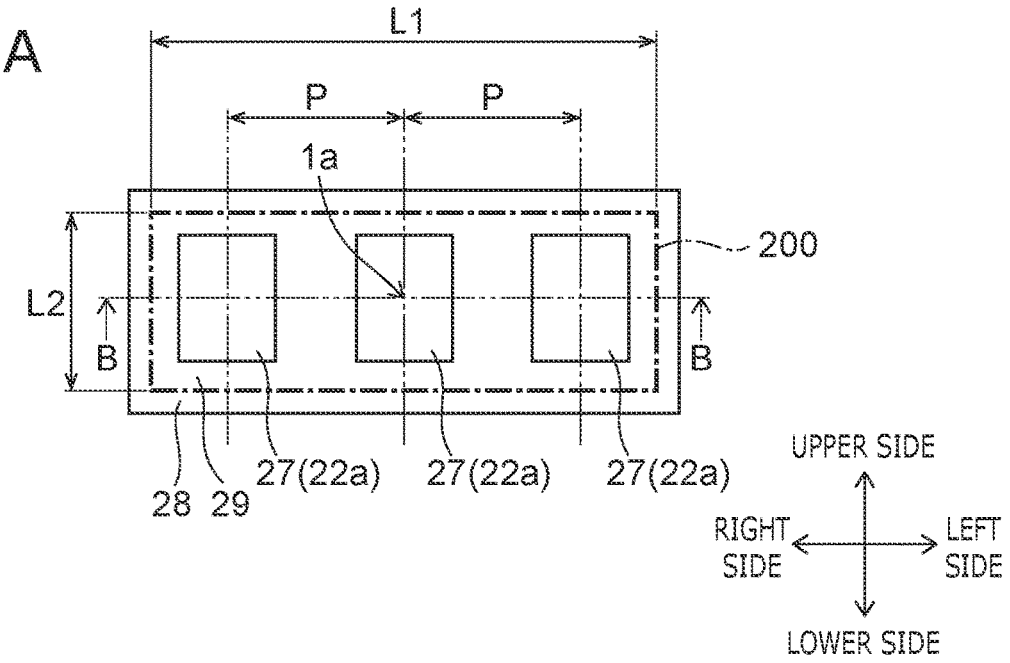
FIG. 7A is a schematic plan view illustrating light-emitting elements and arrangement of the light-emitting elements according to still another embodiment.

FIG. 7A is a schematic plan view illustrating a light-emitting element and arrangement of the light-emitting element according to still another embodiment.

Figure 7B:
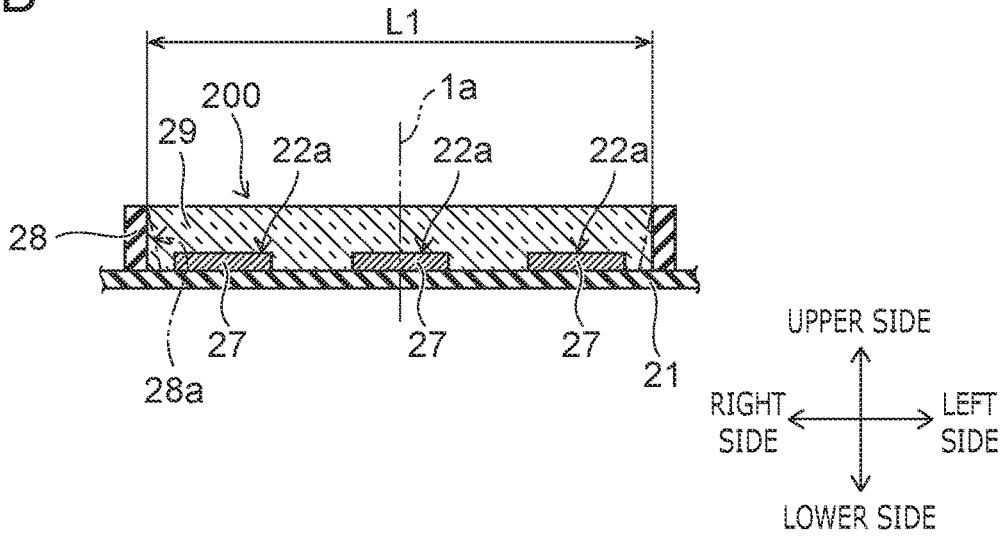
FIG. 7B is a schematic cross-sectional view of arrangement of the light-emitting elements in FIG. 7A in a direction of line B-B.

FIG. 7B is a schematic cross-sectional view of the arrangement of the light-emitting element in FIG. 7A in a direction of line B-B.

As illustrated in FIG. 7A, at the inside of the luminous region 200, three light-emitting elements 27 can be provided in parallel in the right and left direction. Since the light-emitting elements 27 are chip-shaped light-emitting elements, upper surfaces of the light-emitting elements 27 become light-emitting surfaces 22*a*. The light-emitting elements 27 can be provided so that long sides of the light-emitting surfaces 22*a* are aligned in parallel in the right and left direction.

As illustrated in FIG. 7B, for example, the light-emitting elements 27 can be mounted on a board 21 by chip on board (COB). The chip-shaped light-emitting elements 27 can be set as a vertical electrode type light-emitting element, an upper electrode type light emitting element, a flip chip type light-emitting element, or the like.

In addition, a frame-shaped frame part 28 can be provided to surround the three light-emitting elements 27. When viewing the vehicle luminaire 1 from a direction along the central axis 1*a*, an external shape of the frame part 28 can be set to an approximately rectangular shape. When viewing the vehicle luminaire 1 from a direction along the central axis 1*a*, an opening of the frame part 28 can be set to an approximately rectangular shape. The opening of the frame part 28 can be set as the luminous region 200.

The frame part 28 can be provided on the board 21. The frame part 28 can be bonded to the board 21. The frame part 28 can be formed from a resin. For example, the resin can be a thermoplastic resin such as polybutylene terephthalate (PBT), polycarbonate (PC), PET, nylon, polypropylene (PP), polyethylene (PE), and polystyrene (PS). In addition, particles such as titanium oxide can be mixed in the resin to improve reflectance with respect to light emitted from the light-emitting elements 27. In addition, the frame part 28 can be formed from, for example, a white resin.

As illustrated in FIG. 7B, an inner wall surface of the frame part 28 can be set as a surface that is approximately orthogonal to a surface of the board 21, or can be set as an inclined surface 28*a*. The inclined surface 28*a* is inclined in a direction to be spaced apart from the central axis of the frame part 28 as being spaced apart from the board 21. When the inner wall surface of the frame part 28 is the inclined surface 28*a*, light incident to the inner wall surface is likely to be emitted toward the front side of the vehicle luminaire 1. That is, the frame part 28 can have a function of a reflector.

A sealing part 29 can be provided on an inner side of the frame part 28. The sealing part 29 is provided to cover the inner side of the frame part 28. The sealing part 29 can be formed from a material having translucency. The sealing part 29 can be formed by filling the inner side of the frame part 28 with a resin. Filling with the resin can be performed, for example, by using a dispenser or the like. For example, the filling resin can be set as a silicone resin or the like.

A phosphor can be contained in the sealing part 29. In addition, a wavelength conversion sheet (sheet containing the phosphor) can also be provided on the light-emitting surfaces 22*a* of the light-emitting elements 27. The wavelength conversion sheet can be obtained by dispersing a granular phosphor inside a resin sheet having translucency. For example, the phosphor can be set as an yttrium-aluminum-garnet-based phosphor (YAG-based phosphor). However, the type of the phosphor can be appropriately changed so as to obtain a desired emission color in correspondence with the use of the vehicle luminaire 1 or the like.

FIGS. 8A to 8D are schematic plan views illustrating a light-emitting element and arrangement of the light-emitting element according to still another embodiment.

Figure 8A:
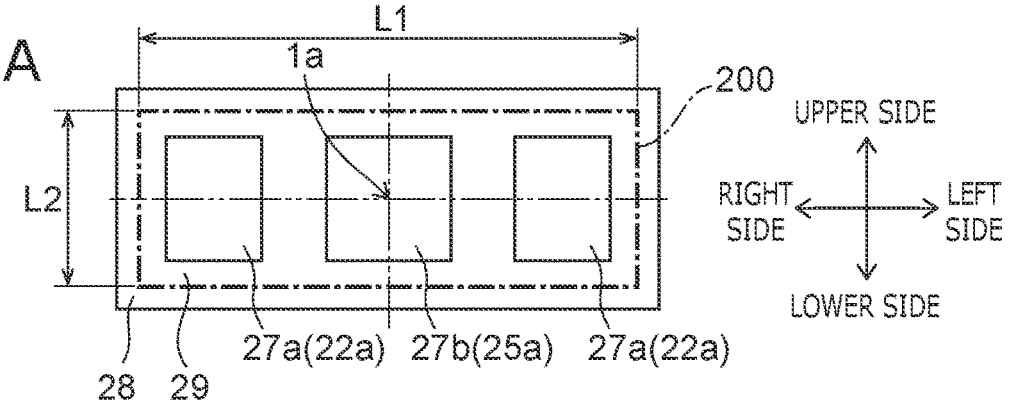
FIGS. 8A to 8D are schematic plan views illustrating light-emitting elements and arrangement of the light-emitting elements according to still another embodiment.

As illustrated in FIG. 8A, a chip-shaped light-emitting element 27*a* including the light-emitting surface 22*a* illustrated in FIG. 5, a chip-shaped light-emitting element 27*b* including the light-emitting surface 25*a* illustrated in FIG. 5, the frame part 28 that surrounds the elements, and the sealing part 29 provided on an inner side of the frame part 28 can also be provided.

Figure 8B:
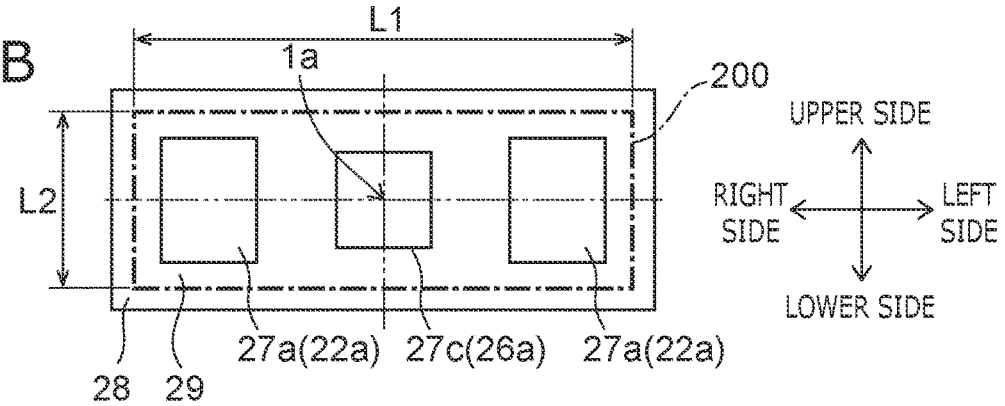

As illustrated in FIG. 8B, a chip-shaped light-emitting element 27*a* including the light-emitting surface 22*a* illustrated in FIG. 6A, a chip-shaped light-emitting element 27*c* including the light-emitting surface 26*a* illustrated in FIG. 6A, the frame part 28 that surrounds the elements, and the sealing part 29 provided on an inner side of the frame part 28 can also be provided.

Figure 8C:
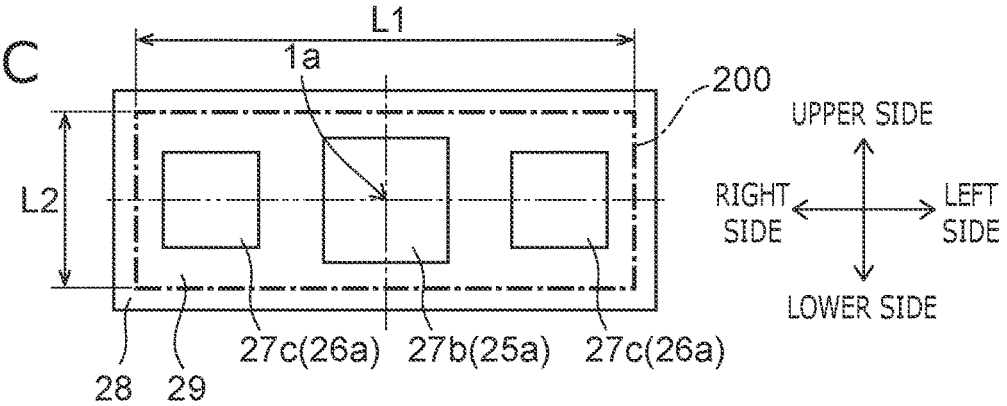

As illustrated in FIG. 8C, a chip-shaped light-emitting element 27*c* including the light-emitting surface 26*a* illustrated in FIG. 6B, a chip-shaped light-emitting element 27*b* including the light-emitting surface 25*a* illustrated in FIG. 6B, the frame part 28 that surrounds the elements, and the sealing part 29 that is provided on an inner side of the frame part 28 can also be provided.

Figure 8D:
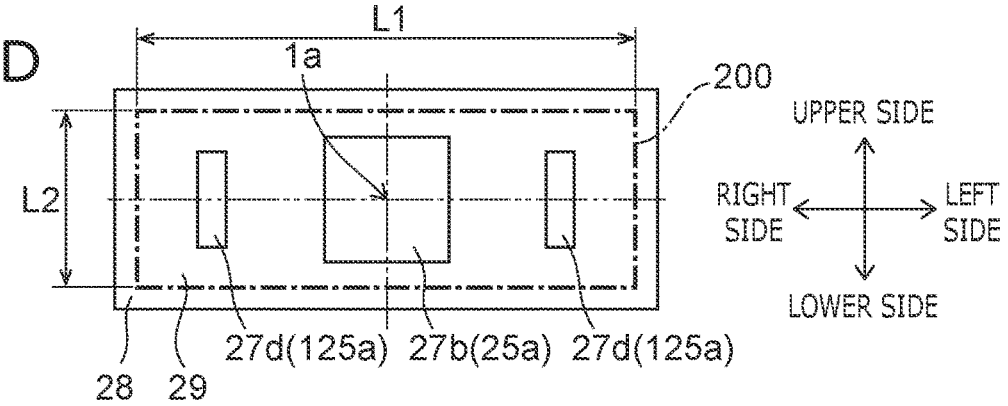

As illustrated in FIG. 8D, a chip-shaped light-emitting element 27*d* including the light-emitting surface 125*a* illustrated in FIG. 6C, a chip-shaped light-emitting element 27*b* including the light-emitting surface 25*a* illustrated in FIG. 6C, the frame part 28 that surrounds the elements, and the sealing part 29 that is provided on an inner side of the frame part 28 can also be provided.

Note that, an electrode may be included in a light-emitting surface of a chip-shaped light-emitting element. For example, an electrode may be included in a light-emitting surface of the vertical electrode type light-emitting element, or a light-emitting surface of the upper electrode type light-emitting element.

An operation and an effect of the chip-shaped light-emitting elements are similar as in the case of the above-described surface mounting type light-emitting element, and thus detailed description thereof will be omitted.

(Vehicle Lighting Tool)

Next, the vehicle lighting tool 100 will be described.

Note that, in the following description, as an example, description will be given of a case where the vehicle lighting tool 100 is the front combination light that is provided in automobiles. However, the vehicle lighting tool 100 is not limited to the front combination light that is provided in automobiles.

FIG. 9 is a schematic partial cross-sectional view for illustrating the vehicle lighting tool 100.

As illustrated in FIG. 9, the vehicle luminaire 1, the housing 101, a cover 102, an optical element unit 103, a sealing member 104, and the connector 105 can be provided in the vehicle lighting tool 100.

The housing 101 holds the mounting part 11. The housing 101 has a box shape in which one end side is opened. For example, the housing 101 can be formed from a resin or the like through which light is not transmitted. An attachment hole 101*a*, into which a portion of the mounting part 11 where the bayonet 12 is provided is inserted, can be provided in a bottom surface of the housing 101. A concave part, into which the bayonet 12 provided in the mounting part 11 is inserted, can be provided in a peripheral edge of the attachment hole 101*a*. Note that, description was given of a case where the attachment hole 101*a* is directly provided in the housing 101, but an attaching member including the attachment hole 101*a* may be provided in the housing 101.

When mounting the vehicle luminaire 1 to the vehicle lighting tool 100, the portion of the mounting part 11 where the bayonet 12 is provided is inserted into the attachment hole 101*a*, and the vehicle luminaire 1 is rotated. In this case, the bayonet 12 is held to a fitting part provided in the peripheral edge of the attachment hole 101*a*. This attachment method is referred to as twist-lock.

The cover 102 can be provided to cover an opening of the housing 101. The cover 102 can be formed from a resin or the like having translucency. The cover 102 can be set to have a function of a lens or the like.

Light emitted from the vehicle luminaire 1 is incident to the optical element unit 103. The optical element unit 103 can carry out reflection, diffusion, guiding, condensing, formation of a predetermined luminous intensity distribution pattern, and the like with respect to the light emitted from the vehicle luminaire 1. For example, the optical element unit 103 illustrated in FIG. 9 is a reflector. In this case, the optical element unit 103 reflects the light emitted from the vehicle luminaire 1 to form a predetermined luminous intensity distribution pattern.

The sealing member 104 is provided between the flange 13 and the housing 101. The sealing member 104 can have an annular shape. The sealing member 104 can be formed from a material such as a rubber and a silicone resin which have elasticity.

When the vehicle luminaire 1 is mounted to the vehicle lighting tool 100, the sealing member 104 is sandwiched between the flange 13 and the housing 101. Accordingly, an internal space of the housing 101 is hermetically sealed by the sealing member 104. In addition, the bayonet 12 is pressed against the housing 101 due to an elastic force of the sealing member 104. Accordingly, the vehicle luminaire 1 can be suppressed from being detached from the housing 101.

The connector 105 can be fitted to the ends of the plurality of power-supply terminals 31 exposed to the inside of the hole 10*b*. A power-supply (not illustrated) or the like is electrically connected to the connector 105. Accordingly, when the connector 105 is fitted to the ends of the power-supply terminals 31, the power-supply (not illustrated) or the like and the light-emitting element are electrically connected. The sealing member 105*a* is provided to prevent water from intruding into the hole 10*b*. When the connector 105 including the sealing member 105*a* is inserted into the hole 10*b*, the hole 10*b* is water-tightly sealed.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions. Moreover, above-mentioned embodiments can be combined mutually and can be carried out.

What is claimed is:

1. A vehicle luminaire comprising:

a socket; and a light-emitting module that is provided on one end side of the socket, and includes only three light-emitting elements, when viewing the vehicle luminaire from a direction along a central axis, light-emitting surfaces of the three light-emitting elements having an approximately rectangular shape or an approximately square shape, and at the inside of an approximately rectangular luminous region with the central axis set as the center, the three light-emitting elements being provided in parallel in a row in a direction in which the short sides of the luminous region are parallel, wherein the light-emitting module includes one first light-emitting element and two second light-emitting elements, at the inside of the luminous region, the first light-emitting element is provided in parallel between the second light-emitting elements, and a light-emitting surface of the one first light-emitting element is larger than light-emitting surfaces of the two second light-emitting elements.

2. The luminaire according to claim 1, wherein the one first light-emitting element, and the two second light-emitting elements are surface mounting type light-emitting elements or chip-shaped light-emitting elements.

3. The luminaire according to claim 1, wherein the one first light-emitting element and the two second light-emitting elements are connected in series.

4. The luminaire according to claim 2, further comprising:

a frame part that surrounds the one first light-emitting element and the two second light-emitting elements, wherein the one first light-emitting element and the two second light-emitting elements are the chip-shaped light-emitting elements, and when viewing the vehicle luminaire from a direction along the central axis, an external shape of the frame part is an approximately rectangular shape.

5. A vehicle lighting tool comprising:

the vehicle luminaire according to claim 1; and a housing to which the vehicle luminaire is mounted.

6. The tool according to claim 5, wherein a maximum value of luminance at the periphery of an approximately rectangular luminous region with a central axis of the vehicle luminaire set as the center is 10% or less of average luminance inside the luminous region.

7. The luminaire according to claim 1, wherein when viewing the vehicle luminaire from a direction along the central axis, a light-emitting surface of the first second light-emitting element has an approximately square shape, and light-emitting surfaces of the two third second light-emitting elements have an approximately rectangular shape.

8. The luminaire according to claim 7, wherein a length of a side of the light-emitting surface of the one first light-emitting element is approximately the same as a length of the long sides of the light-emitting surfaces of the two second light-emitting elements.

9. The luminaire according to claim 7, wherein when a length of a side of the light-emitting surface of the first light-emitting element is set as La (mm), a length of a short side of the light-emitting surfaces of the second light-emitting elements is set as Lb (mm), and a length of a long side of the luminous region is set as L1 (mm), an expression of $(Lb+La+Lb)/L1 \leq 0.6$ is satisfied.

10. The luminaire according to claim 7, wherein when viewing the vehicle luminaire from a direction along the central axis, the one first light-emitting element is provided at a position that overlaps the central axis.

11. The luminaire according to claim 7, wherein the one first light-emitting element and the two second light-emitting elements are surface mounting type light-emitting elements or chip-shaped light- emitting elements.

12. The luminaire according to claim 7, wherein the one first light-emitting element and the two second light-emitting elements are connected in series.

13. The luminaire according to claim 11, further comprising:

a frame part that surrounds the one first light-emitting element and the two second light-emitting elements, wherein the one first light-emitting element and the two second light-emitting elements are the chip-shaped light-emitting elements, and when viewing the vehicle luminaire from a direction along the central axis, an external shape of the frame part is an approximately rectangular shape.

14. The luminaire according to claim 1, wherein when viewing the vehicle luminaire from a direction along the central axis, the one first light-emitting element is provided at a position that overlaps the central axis, and the second light-emitting elements are provided one by one on both sides of the first light-emitting element provided at the position that overlaps the central axis.

* * * * *